US008001889B2

(12) United States Patent
Gaugenrieder et al.

(10) Patent No.: US 8,001,889 B2
(45) Date of Patent: Aug. 23, 2011

(54) PROCEDURE AND DEVICE FOR PREVENTING CONTAMINATION OF THE NOZZLES OF A SPRAY DAMPENING UNIT

(75) Inventors: Ernst Gaugenrieder, Diedorf (DE); Guido Pinnekamp, Munster (DE); Michael Baldy, Steinfurt (DE); Robert Holtwick, Telgte (DE); Dietger Hesekamp, Rheda-Wiedenbruck (DE); Hary Kosciesza, Borchen (DE)

(73) Assignee: Technotrans AG, Sassenberg (DE)

( * ) Notice: Subject to any disclaimer, the term of this patent is extended or adjusted under 35 U.S.C. 154(b) by 229 days.

(21) Appl. No.: 12/077,478

(22) Filed: Mar. 19, 2008

(65) Prior Publication Data

US 2008/0271618 A1 Nov. 6, 2008

(30) Foreign Application Priority Data

Mar. 21, 2007 (DE) ..... 10 2007 013 590

(51) Int. Cl.
*B41L 23/08* (2006.01)

(52) U.S. Cl. ..... 101/147

(58) Field of Classification Search ..... 101/147
See application file for complete search history.

(56) References Cited

U.S. PATENT DOCUMENTS

| | | | | |
|---|---|---|---|---|
| 4,241,656 | A | 12/1980 | Smith | |
| 6,928,924 | B2 | 8/2005 | Miyauchi et al. | |
| 2004/0227020 | A1 | 11/2004 | Baldy et al. | |
| 2008/0017733 | A1 * | 1/2008 | Hansson | 239/292 |

FOREIGN PATENT DOCUMENTS

| | | | |
|---|---|---|---|
| DE | 696 18 815 | T2 | 11/1995 |
| EP | 0 572 391 | | 12/1993 |
| EP | 1 155 824 | A2 | 5/2001 |
| EP | 1 386 735 | A2 | 2/2004 |
| EP | 1 391 554 | | 2/2004 |
| EP | 1 479 517 | | 11/2004 |
| WO | 03/097358 | A1 | 11/2003 |
| WO | WO 2005000583 | A1 * | 1/2005 |
| WO | WO 2006/138448 | A2 | 12/2006 |

* cited by examiner

*Primary Examiner* — Joshua D. Zimmerman
(74) *Attorney, Agent, or Firm* — Richard M. Goldberg

(57) ABSTRACT

The invention involves a printing press comprising a spray dampening unit 2 having a spray nozzle cleaning device 3, a spray dampening unit 2 having a spray nozzle cleaning device 3 and a spray nozzle bar 22 having a spray nozzle cleaning device 3. Said spray nozzle cleaning device 3, respectively, was produced with fluid nozzles 34 using a fluid line system 31, the use of a fluid line system with fluid nozzles to produce such a spray nozzle cleaning device and a procedure to clean the spray nozzles 23 of a spray dampening unit by means of such a spray nozzle cleaning device 3. Said spray nozzle cleaning device has been or can be assembled in a spray dampening unit, comprising a fluid line system 31 having several fluid nozzles 34 by means of which a cleaning fluid can be sprayed on the spray nozzles 23.

17 Claims, 6 Drawing Sheets

PROCEDURE AND DEVICE FOR PREVENTING CONTAMINATION OF THE NOZZLES OF A SPRAY DAMPENING UNIT

FIELD OF THE INVENTION

The invention involves a printing press comprising a spray dampening unit having a spray nozzle cleaning device, a spray dampening unit having a spray nozzle cleaning device and a spray nozzle bar having a spray nozzle cleaning device. Said spray nozzle cleaning device, respectively, was produced with fluid nozzles using a fluid line system, the use of a fluid line system with fluid nozzles to produce such a spray nozzle cleaning device and a procedure to clean the spray nozzles of a spray dampening unit by means of such a spray nozzle cleaning device.

BACKGROUND OF THE INVENTION AND PRIOR ART

In prior art dampening units are used in offset printing presses. It is the function of the dampening unit to apply fountain solution evenly on the printing plate of the offset printing presses. The fountain solution is applied to the first roll, for example, by means of a water chamber, nozzles or similarly. Via various other rolls, the roll usually applies a water film to the printing plate as evenly as possible.

The spray dampening units which use fountain solution nozzles to spray the fountain solution on the roll involve the problem that the fountain solution nozzles can be clogged with particles and be closed. Because of low pressure in the area of the nozzles resulting from the flow conditions in the area of the fountain solution nozzles, such particles, for example lint and ink particles from surrounding air, are being absorbed.

Clogged fountain solution nozzles must be cleaned resulting in expensive disruptions of the printing operations.

In order to deal with this problem, prior art has come up with a solution according to which, by means of compressed air, an air cushion is produced around the fountain solution nozzles so that the pressure conditions in the area of the nozzles prevent absorption and clogging of particles. For this purpose, nozzles can be provided around the fountain solution nozzle which blow compressed air in the discharge direction of the fountain solution nozzle, producing the air cushion around the fountain solution nozzle by means of a flow layer of compressed air which flows away from the fountain solution nozzle and prevents contaminated air from entering the fountain solution nozzle. For example, this technology is the subject matter of EP 1 155 824 A2. This thought was further developed in prior art by providing and designing respective covers. At the same time, it seems that providing a cover around the fountain solution nozzle results in further optimizing the flow conditions and thus protecting the fountain solution nozzles against contamination. Possibly, the covers also decrease the amount of compressed air used and make its use more effective. But the applications do not mention this. Respective covers are disclosed in WO 03/097358 A1, WO 2005/000583 A1 and U.S. Pat. No. 6,928,924.

This technology has the disadvantage that an additional air supply is required in the area of the fountain solution nozzles. The generation of an air cushion can also have a negative effect on the fountain solution distribution. Furthermore, compressed air is a relatively expensive medium.

OBJECTIVE

The invention is based on the objective of providing a printing press comprising a spray dampening unit, such spray dampening unit, a spray nozzle bar for such spray dampening unit as well as a procedure to clean the spray nozzles of a spray dampening unit, which guarantee uninterrupted printing operations and minor cleaning efforts of such spray dampening unit.

Solution to the Problem

The problem is solved by the use, devices and procedure according to the supplementary claims. Advantageous embodiments are disclosed in the subordinate claims.

A first aspect of the invention concerns the use of a fluid line system comprising several fluid nozzles to produce a spray nozzle cleaning device which can be mounted in a spray dampening unit for the purpose of cleaning spray nozzles of a spray dampening unit in printing presses, in particular in offset printing presses.

Spray nozzles in this sense are spray nozzles which spray, in a spray dampening unit, fountain solution on respective rolls of a dampening unit. By means of said rolls, the fountain solution is transported to the printing plate. In this way, a printing press can be provided which features a dampening unit in which the fountain solution is applied by means of spray nozzles. To this end, a spray nozzle cleaning device is provided in the area of the spray dampening unit by means of which the spray nozzles can be cleaned if the spray nozzle opening is blocked with contaminants, or in order to prevent such blockage.

By means of the fluid line system, a cleaning fluid can be transported to the fluid nozzles and from these directed to the spray nozzles in order to clean them by means of the cleaning fluid. Such spray nozzle cleaning device can be actuated manually or automatically as required, or at the end of certain production cycles. It is no longer required to clean the spray nozzles by hand, to interrupt the production cycle for the purpose of cleaning or to provide complex protective mechanisms for the spray nozzles.

By means of such a spray nozzle cleaning device it is possible to reduce the operating expenses. To this end it became evident that it is usually sufficient to carry out the cleaning of the spray nozzles at the end of a respective production cycle since problems arise if contaminants dry, which usually occurs only if the press is not in use or not in operation. Alternatively or additionally it is also possible to clean the spray nozzles while the press is in operation.

An advantageous embodiment involves such use in which a fluid nozzle is provided for each spray nozzle of the spray dampening unit. It is designed and arranged at the fluid line in such a way that, by means of it, a fluid jet, which is directed to a spray nozzle, can be produced. In a printing press comprising a spray dampening unit having a spray nozzle cleaning device in which, at the fluid line system, a fluid nozzle has been provided for each spray nozzle of the spray dampening unit, it is possible, by means of a specific fluid jet, preferably at the end of a production period, to spray pressurized fountain solution for a brief period on the nozzle outlets.

In this way, it is possible to remove ink mist residue and other contaminants sticking on the nozzle outlet.

Also preferred is an embodiment in which the fluid line system comprises adjusting means designed in a way that the discharge direction of the fluid nozzles can be adjusted via the adjusting means. A respective printing press comprising such spray dampening unit having a spray nozzle cleaning device features a fluid line system having fluid nozzles in which the fluid line system comprises adjusting means by means of which the discharge direction of the fluid nozzles can be adjusted. This has the advantage that such fluid line system is easy to assemble and adjust or re-adjust.

Preferably, such use features a design in which the fluid line system has an attachment by means of which the fluid line system can be connected to a fluid source. A respective printing press comprising a spray dampening unit having a spray nozzle cleaning device features a fluid line system having fluid nozzles and an attachment by means of which the fluid line system can be connected to a fluid source. By means of such attachment, the fluid line system can be easily connected to available line systems of a dampening unit in order to utilize as cleaning media the available fluids.

In another preferred design, the fluid line system can be connected via an attachment to the fluid supply of the printing press, preferably a fountain solution line of the spray nozzles. This has the advantage that the spray nozzle cleaning device does not require a special feed line for the cleaning fluid, allowing available dampening units to be refitted without difficulty. Furthermore, using fountain solutions as cleaning fluid has the advantage that it is possible to use even available disposal circuits or devices. For example, the cleaning medium can be discharged via an available drain outlet to be disposed or processed via a suitable filtration procedure for future use. This has the advantage that, because of the temporary use of the spray nozzle cleaning device, neither the consumption of fountain solution nor the amount of waste water increases noticeably.

In another advantageous embodiment, the fluid line system features a fluid valve by means of which the fluid discharge can be controlled. Said fluid discharge can be controlled, for example, with regard to the specific time of the fluid discharge, duration and/or pressure with which the fluid is being discharged. This has the advantage that the cleaning process can be adapted to specific contamination situations and/or to the operation of the printing press.

It is preferable if the fluid line system features for each fluid nozzle one fluid valve by means of which the fluid discharge of the respective fluid nozzle can be controlled. Also in this case it is possible to control, for example, the specific time, duration and/or pressure. From a central fluid line which supplies several fluid nozzles with cleaning fluid, a respective nozzle line can be provided leading from the central fluid line to the respective fluid nozzle. The fluid valve for this particular fluid nozzle is provided in the nozzle line. This embodiment has the advantage that individual spray nozzles can even be cleaned separately. This reduces the consumption of cleaning fluid. Furthermore, this embodiment has the advantage that disruptions in the printing operations can be minimized if only those nozzles are cleaned for which cleaning is required.

Preferably this particular embodiment comprises a fluid line system featuring a control unit by means of which the fluid valve(s) can be controlled.

In a further advantageous embodiment, the fluid line system can be connected with several fluid sources containing different fluids. By means of such an embodiment of the spray nozzle cleaning device, the cleaning procedure can be optimized. For example, first of all preliminary cleaning can be performed with a cleaning agent, softening the contaminants. Subsequently, fountain solution can be used for rinsing. Finally, the spray nozzles can be air dried. To this end, it is possible to add the cleaning agent in the first step to the fountain solution or to use a preprocessed cleaning agent. Via different supply lines, the different fluids can be directed successively or simultaneously to one line of the fluid line system. It is also possible to provide in the spray nozzle cleaning device various separate line systems for various fluids.

Another preferred embodiment provides several fluid nozzles for each spray nozzle which, preferably can be supplied independently with different fluids. Several fluid nozzles for each spray nozzle can improve the cleaning effect. The use of different fluids has the advantages mentioned above.

In another advantageous embodiment, the fluid discharge of the different fluids can be controlled separately.

In yet another embodiment, the fluid line system can be assembled to a nozzle bar of the spray dampening unit and/or in the spray chamber of the spray dampening unit. Nozzle bars in spray dampening unit are frequently designed to be exchanged. This means that such nozzle bars form an independent unit within the dampening unit which can be attached to the dampening unit or detached. In some cases dampening units can be refitted with such nozzle bars. To make arrangements for attaching spray nozzle cleaning devices to such a nozzle bar has the advantage that a spray nozzle cleaning device can be pre-assembled to such a nozzle bar and simply assembled to the dampening unit together with the nozzle bar. It is also possible to assemble a spray nozzle cleaning device not at the nozzle bar but instead in the spray chamber in front of the nozzle bar to a different component of the dampening unit or the printing press. Preferably, the openings of the fluid nozzles have a distance to the nozzle outlets of between 1 cm and 4 cm, preferably between 1.5 cm and 3 cm, especially preferably approximately 2 cm. Preferably the fluid nozzles are arranged in such a way that the fluid jet produced by the fluid nozzles is set an angle of between 30° and 60°, preferably 45° in relation to the spraying level of the spray jet produced by the spray nozzles.

Furthermore, in a preferred embodiment the pressure of the fluid(s) in the fluid line system is produced via the connection of the fluid line system at the fluid source(s), and/or one or several pumps are designed to produce the pressure. If the pressure is provided via the connection to the fluid source, it has the advantage that no additional pump is required. A pump, in turn, has the advantage that the pressure can be adapted to a specific use of the cleaning device.

In another preferred embodiment, the fountain solution in the fluid line system can be supplied with a pressure of between 2 bar and 20 bar, preferably between 3 bar and 15 bar, especially preferably approximately 6 bar.

A second aspect of the invention concerns a nozzle bar having assembled to it a spray nozzle cleaning device which is produced by using the fluid line system described above. Such a nozzle bar can be provided as a separate component together with a spray nozzle cleaning device and simply assembled in a dampening unit. In such a way, printing presses or dampening units can be refitted.

Preferably, such a nozzle bar comprises at least one protective cap surrounding at least one spray nozzle and a spray jet aperture which is designed in a way that a spray jet produced by the spray nozzle can be sprayed through the spray jet aperture at which at least one fluid nozzle which is attached to at least this one spray nozzle is arranged inside the protective cap. The protective cap can have a wall designed in such a way that inside the wall an interior space is generated which surrounds the spray nozzle. The wall can surround the spray nozzle like a cup which has an edge that seals the inside of the edge area of the protective cap in the direction of the nozzle bar. The spray jet aperture can be arranged at the bottom of the cup-like protective cap. The protective cap can be designed in a way that the interior space of the protective cap can accept only one spray nozzle. The protective cap can be designed also in a way that the interior space of the cap can accept two, several or all spray nozzles of the spray bar. To this end, each spray nozzle can be provided with one spray jet aperture. The protective cap can be designed in a way that, except for the spray jet aperture, the wall does not feature any openings which connect the interior space of the protective cap with the spray chamber. Such a protective cap separates the spray nozzle form the spray chamber. Basically, the spray chamber is the space between the spray nozzles and the body to be dampened by the spray dampening unit. In embodiments including a description of the protective cap, the term spray chamber depicts merely the space outside of the protective cap of the body to be dampened. The spray jet aperture can comprise an opening which is adapted to the cross section of a spray jet produced by the spray nozzle. Such cross section can be oblong. For example, a fluid nozzle provided to be inside the protective cap can be situated in the center area of such oblong spray jet aperture between the two longitudinal ends of the spray jet aperture. It is also possible that several fluid nozzles are provided inside the protective cap and are arranged, for example, at both longitudinal ends of the oblong spray jet aperture and/or in the center area between both longitudinal ends of the oblong spray jet aperture.

Such nozzle bar can also be designed in a way that the spray nozzle and the appropriate spray jet aperture are designed and arranged together in such a way that they form a jet pump, at which the interior space of the protective cap is flow-connected to an unpressurized pure-air reservoir. This embodiment has the advantage that air from the pure-air reservoir is discharged through the protective cap to the outside into the spray chamber. This prevents contaminated air from leaving the spray chamber and traveling in reverse direction to the inside of the protective cap in order to attach to the spray nozzle. A jet pump according to the invention is an arrangement in which the pump effect is produced by means of a fluid jet, which is usually depicted as "propulsion medium." Through impulse exchange, the propulsion medium can absorb and discharge a different medium, which is usually depicted as "suction medium." The propulsion medium in the invention-based jet pump is a fountain solution which is sprayed through the spray nozzles. The suction medium in the invention-based jet pump corresponds to the pure air which can be discharged from the unpressurized pure-air reservoir through the spray jet aperture into the spray chamber. On the one hand, this can be based on the principle that, because of the speed of the spray jet, the air around the spray jet has less pressure than the air at a larger distance of the spray jet. On the other hand, friction between the spray jet and the surrounding medium results in the fact that the surrounding medium is moved in spray direction. The term unpressurized pure-air reservoir depicts an air volume which contains air that, unlike the air in the spray chamber, is not contaminated. For example, such pure-air reservoir can be connected to the surrounding air via a filter opening. To this end, a filter of the filter opening can be designed in such a way that the surrounding air can flow into the pure-air reservoir without noteworthy flow resistance, resulting in the fact that basically ambient pressure prevails in the pure-air reservoir, guaranteeing that the absorbed air is not contaminated with contaminants. The air volume can be provided, for example, in the nozzle bar or as a separate volume, which is connected with the inside of the nozzle bar and, via the inside of the nozzle bar, with the inside of the protective cap. It is also possible that alternatively or additionally the inside of the protective cap is connected to the separate volume via a line. The term "unpressurized" in this context means that no special pressure source is required, for example, a compressor which supplies the pure-air reservoir with pressure higher than the pressure in the spray chamber in order to discharge air from the pure-air reservoir through the protective cap to the outside into the spray chamber. This has the advantage that it is not required to use such a pressure source. As a result, the invention-based device becomes less expensive and less failure-prone.

A third aspect of the invention concerns a spray dampening unit comprising an attached spray nozzle cleaning device which is produced by using the fluid line system described above.

Such a spray dampening unit can also comprise at least one protective cap surrounding at least one spray nozzle and a spray jet aperture which is designed in a way that a spray jet produced by the spray nozzle can be sprayed through the spray jet aperture at which at least one fluid nozzle which is attached to at least this one spray nozzle is arranged inside the protective cap.

Furthermore, in such a spray dampening unit, the spray nozzle and appropriate spray jet aperture can be designed and arranged together in such a way that they form a jet pump, at which the interior space of the protective cap is flow-connected to an unpressurized pure-air reservoir.

Further possibilities of design and advantages of such a spray dampening unit can be derived from the above-mentioned embodiments with regard to the nozzle bar.

A fourth aspect of the invention concerns a printing press which can be designed with one of the spray dampening units described above, comprising an assembled spray nozzle cleaning device which is produced using such fluid line systems as described above.

A fifth aspect of the invention concerns a procedure to prevent contamination of spray nozzles of a spray dampening unit involving the following steps:

- providing a spray dampening unit comprising several assembled spray nozzles,
- separating at least one of the spray nozzles from surrounding air through a protective cap,
- providing a spray jet aperture at the protective cap which is designed in such a way that a spray jet produced by the spray nozzle can be sprayed through the spray jet aperture,
- providing a pure-air reservoir that is separated from the surrounding air,
- producing a flow connection between a pure-air reservoir and the interior space of a protective cap surrounding at least one spray nozzle,
- providing uncompressed pure air in the pure-air reservoir,
- adjusting aperture geometry of the spray jet aperture in relation to the spray jet geometry of a spray jet produced by the spray nozzle in such a way that, because of the flow speed of the spray jet, low pressure is produced in the spray jet aperture which results in additional flow of pure air from the pure-air reservoir to the inside of the protective cap.

By means of the procedural steps described, a jet pump is provided as described above with regard to the nozzle bar. The explanations at the appropriate places therefore provide other possible procedural steps or possible embodiments of the procedural steps mentioned. The term "separating" as used has to be seen in this context and means a protection which results in the fact that no openings are provided at the protective cap which would allow contaminated air to access the spray nozzle. At the same time, because of the adjustment of the aperture geometry of the spray jet aperture in relation to the spray jet geometry of a spray jet produced by the spray nozzle, pure-air flow can be produced in the spray jet aperture which prevents contaminated air from the spray chamber to enter the spray nozzle through the spray jet aperture. To this end, the aperture geometry of the spray jet aperture can be chosen in such a way that the spray jet produced adheres closely to the spray jet aperture. In the closest area of the spray jet aperture, it proved to be advantageous to have distances of between 0 mm and 3 mm between the edge areas of the spray jet aperture and the spray jet. It is particularly advantageous to have distances larger than 0 mm and/or smaller than 0.7 mm. It is also possible that the aperture area of the spray jet aperture extends over a certain distance in spray direction, for example, over a length of between 0 mm and 15 mm, particularly over a length larger than 0 mm and/or 5 mm. Over this length the cross section of the aperture can have a variety of designs. To be considered is, for example, a venture-like design. For example, in the spray jet aperture first a confuser area with an initially larger cross section can be provided which narrows to a nozzle area with the smallest area mentioned above and finally changes to an expanding diffuser area. The nozzle area can also be depicted as collar area. It is also possible to have an embodiment without confuser area and/or without diffuser area. The protective cap can be designed in a way that in mounted condition of the protective cap a spray nozzle outlet of the spray nozzle is arranged at a distance in front of the spray jet aperture, providing a mixing area in which the spray jet moves unaffected by a nozzle-like embodiment of the spray jet aperture before entering, for example, the confuser area or immediately the collar area of the spray jet aperture. Otherwise, reference is made to the preceding explanations.

In such a procedure, the flow connection with the pure-air reservoir can be achieved by providing a housing aperture in a housing part of the spray unit adjoining the interior space of the protective cap. The housing aperture connects the interior space of the protective cap with an interior space of the spray unit housing.

In such a procedure, the flow connection can also be achieved by providing a pure-air line which establishes the flow connection between the interior space of the protective cap and the pure-air reservoir outside the housing interior. Preferably, the pure-air line connects the interior spaces of several protective caps with each other. For example, such a pure-air line can be provided by means of a tube or pipe which connects the interior space of a protective cap with the pure-air reservoir and/or other protective caps.

Such procedure can comprise the following steps:

- providing the spray dampening unit (2) with a spray nozzle cleaning device (3) assembled to it, which has been produced according to one of claims 1 through 10 using a fluid line system (31), and
- producing a fluid jet (33) from one of the fluid nozzles (34), which is directed to one of the spray nozzles (23).

In this regard, a combination of jet pump effect and fluid jet cleaning is especially effective, preventing particularly reliable disruption of the operating procedure since it is possible to avoid with high reliability and little constructive effort contamination of the spray nozzles. If contamination occurs anyway it can be eliminated with high reliability and little constructive effort by means of a fluid jet cleaning process.

A sixth aspect of the invention concerns a procedure to clean the spray nozzles of a spray dampening unit which involves the following steps:

- providing a spray dampening unit with a spray nozzle cleaning device assembled to it, which has been produced using a fluid line system as described above, and producing
- a fluid jet from one of the fluid nozzles, which is directed to one of the spray nozzles, in particular to the spray nozzle outlet of the spray nozzle.

According to the possibilities provided by a spray nozzle cleaning device described above, the procedures described can be modified. For example, such procedure can comprise a parallel or subsequent use of different cleaning fluids. Furthermore, the cleaning process can be interrupted in order to dissolve or remove contaminations by applying a cleaning medium. The procedure can involve drying phases. It is also possible to provide measures of monitoring the printing process in order to detect a blockage of the spray nozzles or one spray nozzle. A cleaning process can be initiated automatically and/or by means of signals transmitted to the machine operator who can initiate or supervise manually a cleaning process.

A seventh aspect of the invention concerns a protective cap to be used in connection with a spray nozzle of a spray dampening unit in printing presses. Said protective cap can be placed around a spray nozzle and comprises a spray jet aperture which is designed in a way that a spray jet produced by the spray nozzle can be sprayed through the spray jet aperture. The spray jet aperture, in turn, has an aperture geometry that is adjusted in relation to the spray jet geometry in such a way that by means of the protective cap at the spray nozzle a jet pump is formed through which an air flow can be produced in the spray jet aperture when the spray dampening unit is in operation. Said air flow flows from the interior space of the protective cap into a spray chamber outside of the protective cap.

With such a protective cap, the aperture of a nozzle area of the spray jet aperture can have over a certain distance in spray direction of the spray jet a basically constant cross section of the opening which closely follows the spray jet. For example, the walls in the nozzle area can have a distance form the spray jet of between 0 mm and 3 mm. Particularly advantageous are distances larger than 0 mm and/or smaller than 0.7 mm. It is also possible that the nozzle area has a convex surface so that the narrowest area in spray direction extends only over a short distance in spray jet direction. Also regarding such convex nozzle areas, it has been advantageous if, in the narrowest area of the spray jet aperture, the distances between the edge areas of the spray jet aperture and the spray jet are between 0 mm and 3 mm. Particularly advantageous are distances larger than 0 mm and smaller than 0.7 mm.

Such protective cap can also comprise a spray jet aperture which has in spray direction a diffuser area adjoining the nozzle area. In this case, preferably starting from the cross section of the aperture in the nozzle area, the cross section of the aperture in the diffuser area gradually opens like a funnel.

The protective cap thus described can also comprise a spray jet aperture which has in spray direction a confuser area assembled in front of the nozzle area. In this case, preferably the cross section of the aperture in the confuser area gradually narrows like a funnel until it reaches the cross section of the aperture in the nozzle area.

At the same time, the aperture area of the spray jet aperture thus described can extend over a certain distance in spray direction, for example, over a distance of between 0 mm and 15 mm, in particular over a distance larger than 0 mm and/or 5 mm. As described, over this distance, the cross section of the aperture can have a variety of designs. To be considered is, for example, a venturi-like design comprising a confuser area, nozzle area and/or diffuser area. It is also possible to have an embodiment without confuser area and/or without diffuser area. In this case, the linear measures mentioned refer to the extension in spray jet direction without confuser area or without diffuser area.

Such protective cap can be designed in a way that in mounted condition of the protective cap a spray nozzle outlet of the spray nozzle is arranged at a distance in front of the spray jet aperture, providing a mixing area. In such mixing area, which can also be depicted as mixing chamber, the spray jet can move unaffected by a nozzle-like embodiment of the spray jet aperture before entering, for example, the confuser area or immediately the collar area of the spray jet aperture. In this way, advantageously, an impulse can be transmitted to the surrounding pure air which improves a pump effect of the protective cap at the spray nozzle.

An eighth aspect of the invention concerns a protective-cap spray-nozzle combination, comprising a spray nozzle of a spray dampening unit of a printing press and a protective cap as described above.

A ninth aspect of the invention concerns a spray dampening unit of a printing press comprising the protective-cap spray-nozzle combination described above.

Such spray dampening unit can also feature a pure-air reservoir and a flow connection, connecting the interior space of the protective cap and the pure-air reservoir.

Furthermore, with such spray dampening unit, it is possible to provide the flow connection in the form of a pure-air line, which connects the interior space of the protective cap with the pure-air reservoir, and/or in the form of a housing aperture. Said housing aperture is provided in a housing part of the spray unit adjoining the interior space of the protective cap and connecting the interior space of the protective cap with an interior space of the spray unit housing.

In addition, such spray dampening unit comprises a spray nozzle cleaning device arranged at a spray dampening unit, which has been produced using a fluid line system described at the beginning with regard to the first aspect of the invention.

The subsequent descriptions are especially preferred exemplified embodiments of the invention. At the same time, the embodiment described comprises some characteristics which are not necessarily imperative in order to implement the invention. However, generally these are considered to be preferable or advantageous. Therefore, the model of the invention should include even embodiments which do not comprise all of the characteristics of the subsequently described embodiment.

DETAILED DESCRIPTION OF THE DRAWINGS

Figure 1:
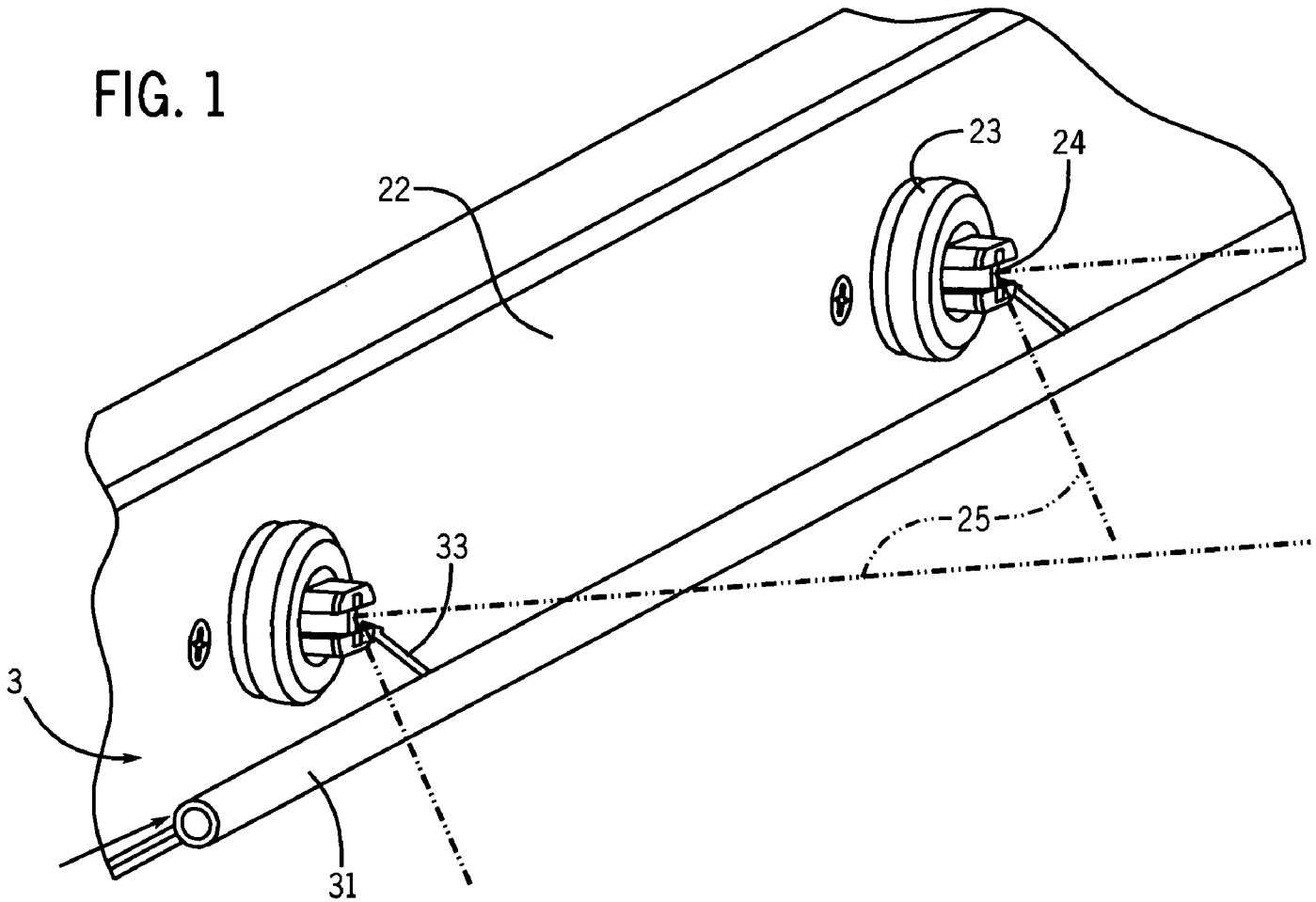
FIG. 1 a section of a nozzle bar of a spray dampening unit of an offset printing press comprising a spray nozzle cleaning device according to a preferred embodiment of the invention in an isometric view, FIG. 2 a partial side view of the nozzle bar from FIG. 1
Figure 2:
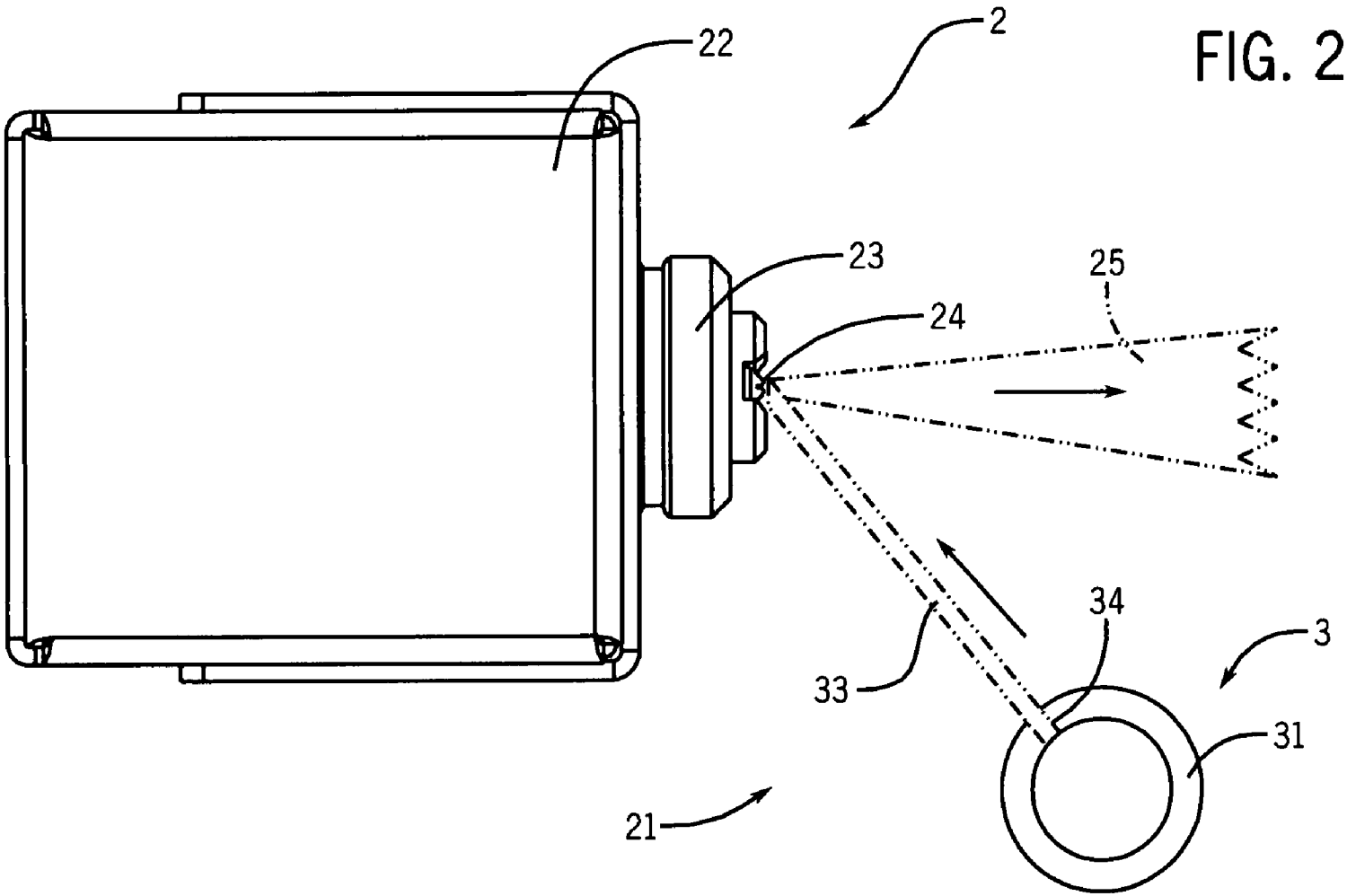

FIG. 1 shows a section of a nozzle bar 22 of a spray dampening unit 2 of a printing press comprising a spray nozzle cleaning device 3 according to a preferred embodiment of the invention in an isometric view. Preferably, the printing press is an offset printing press in which the printing plate is dampened via a spray dampening unit 2. FIG. 2 shows a partial side view of the nozzle bar 22 from FIG. 1.

In such spray dampening unit 2 of which merely the nozzle bar 22 is shown the rolls are dampened with a fountain solution by means of spray nozzles 23. Preferably, such spray nozzles 23 consist of flat jet nozzles which form a fountain solution spray jet 25 in order to spray the roll to be dampened. Basically, as shown in FIG. 1, the spray jet 25 is formed on a level and, beginning at the spray nozzle outlet 24, it expands in a jet angle. At the same time, the flat jet nozzles are preferably arranged on a nozzle bar 22, which can also be depicted as spray bar, in such a way that the surface of a rotating roll of the dampening unit 2 can be evenly dampened.

Printing presses or dampening units 2 can be refitted with such nozzle bars 22. Depending on the model, such nozzle bars 22 can be attached as complete components to the dampening unit or detached. Even the individual spray nozzles 23 can be arranged at the nozzle bar 22 in such a way that they can be exchanged.

Preferably, the roll in the dampening unit 2 is being dampened by means of a quick succession of spray jets from the flat jet nozzles. Because of the flow conditions in the area of a spray jet 25, pressure fluctuations can occur in the area of the nozzle outlet 24. As a result of the pressure fluctuations, ink particles of ink mist or lint from air surrounding the nozzle outlet 24 can settle on it.

Such residues can dry on the nozzle outlet 24 resulting in the fact that the spray nozzles 23 are constricted or clogged and the rolls can no longer be dampened evenly. Tests have shown that such drying of residues usually occurs only during production breaks if the spray nozzles 23 are not used. To prevent this, the invention-based spray nozzle cleaning device 3 has been placed in the area of the spray nozzles in order to be able to clean the spray nozzles 23 preferably immediately after the conclusion of a production cycle. If a spray nozzle 23 should be clogged during a production cycle, the spray nozzle cleaning device 3 can even be used during a production cycle.

The spray nozzle cleaning device 3 comprises a fluid line system 31, which in the preferred embodiment shown involves a thin supply line, which is located just before and somewhat beneath the flat jet nozzles. Alternatively or additionally, it is also possible to place a fluid line system 31 above or laterally of the spray nozzles 23. The figure does not show the mounting device of the supply line. Preferably, the supply line is assembled at the spray bar 22 so that it can be attached and detached together with the spray bar 22. It is also possible to assemble the supply line at other components of the spray dampening unit 2, separate from the spray bar 22.

In the supply line of the fluid line system 31, in front of the spray nozzles 23, there are small holes pointing in the direction of the spray nozzle outlet 24. If the supply line is supplied with a cleaning agent, it is possible, through fluid nozzles 34 which are formed by the small holes, to spray a fluid jet 33 exactly on the spray nozzle outlet 24 in order to eliminate residues. Alternatively or additionally the fluid nozzles can consist of particular components which are connected or screwed to one section of the supply line. In the fluid line system, adjusting means for individual fluid nozzles 34 can be provided, which are designed in such a way that the fluid jet 33 is directed exactly on the respective nozzle outlet 24.

Preferably the cleaning agent is supplied with pressure of approximately 6 bar. It is also possible to use lower or considerably higher pressure. With regard to lower pressure, it is sufficient to have pressure of approximately 2 to 3 bar. In case of significant contamination, pressure of approximately 20 bar or more can be used. Because of the kinetic energy of the cleaning agent (for example fountain solution), preferably combined with dissolution/removal of the contamination, contaminations can be effectively removed.

To this end, one or several fluid nozzles 34 can be provided in the fluid line system 31 for each spray nozzle outlet 24. The fluid discharge can be combined to the spray nozzle outlet 24 from one or several fluid nozzles 34. Preferably, the distance between fluid nozzle 34 and spray nozzle outlet 24 consists of approximately 2 cm. It is also possible to have a small distance, for example, if the fluid nozzle 34 is designed as integral part of a spray nozzle. It is also possible to use a larger distance, in particular if the fluid line system 31 is operated with high pressure, providing the fluid jet 33 with cleaning effect even over a larger distance. Preferably, the fluid jet 33 comprises a 45 .degree. angle toward a level which is expanded by means of the spray jet 25.

As shown in the figures, a straight circuit-cylindrical pipe extends in front of the spray nozzles 23 along a straight line. In the preferred embodiment, a drill hole is provided in the pipe for each spray nozzle 23. In a precise assembly, such a pipe can be produced in such a way that the individual fluid nozzles 34 cannot be adjusted individually. Instead, if the pipe is attached in front of the spray bar 22, the drill holes can be arranged in such a way that each fluid jet 33 from one of the drill holes exactly reaches the spray nozzle outlet 24 of the respective drill hole. However, it is also possible to provide at the fluid line system 31 mountable nozzles, instead of simple drill holes, which in addition comprise adjusting means, making it possible that particular or all fluid nozzles 34 can be directed exactly on the respective spray nozzle outlet 24.

The fluid line system 31 of the spray nozzle cleaning device 3 can be connected to a fluid supply 25 of the spray dampening unit 2, for example with the fountain solution supply of the spray nozzles 23. In this case, the spray nozzle cleaning device 3 can be operated with fountain solution. To this end, the fluid line system 31 of the spray nozzle cleaning device can preferably comprise an attachment which can be detachably connected with the fluid supply of the spray nozzles 23 of the dampening unit 2, for example via a snap closure. In this case, the spray nozzle cleaning device 3 can be supplied with the pressure which is provided by means of the fluid supply.

It is also possible to provide separately one or several pumps which provide, for example, higher pressure. In addition, it is possible that the fluid line system 31 of the spray nozzle cleaning device 3 is connected to other fluid systems of the dampening unit 2 or the printing press or an individual fluid source. For example, the fluid system of a rubber blanket washer could be considered. In this case, the spray nozzle cleaning device 3 can be operated with rubber blanket cleaning agent.

Particularly if the fluid line system 31 is connected to a fluid supply which is available in the printing press, preferably fluid valves are provided by means of which the spray nozzle cleaning device 3 can be put in operation independent of the spray nozzles 23. To this end, it is sufficient to provide one fluid valve for each spray bar 22, each dampening unit 2 and/or each pressure tower.

It is also possible to provide one fluid valve for several or for each individual fluid nozzle 34. In this case, the fluid nozzles can be specifically used individually, for example, if only individual spray nozzles 23 are contaminated.

This embodiment is particularly advantageous if the fluid nozzle 34 is designed as part of a spray nozzle 23. In this case, a fluid valve can be provided in the spray nozzle 23. Such embodiment has the advantage that no external fluid line system must be directed along the nozzle bar 22 or in front of the nozzle bar 22.

The cleaning process can be initiated by means of an electronic control device and/or by means of an operator.

It is also possible to provide a spray nozzle cleaning device 3 comprising several fluid line systems 31 which are operated with different cleaning fluids. In this regard the use of compressed air could be considered, for example, for a preliminary cleaning of loose particles and/or for drying after a cleaning step using fountain solution.

Furthermore, it is possible to operate a fluid line system 31 with different fluids. For example, in a first cleaning step, fountain solution can be mixed with a cleaning agent and can be used undiluted in subsequent cleaning steps. Individual or several fluid line systems 31 can be provided with a heating unit in order to be able to heat the cleaning medium to improve the cleaning effect.

Figure 3:
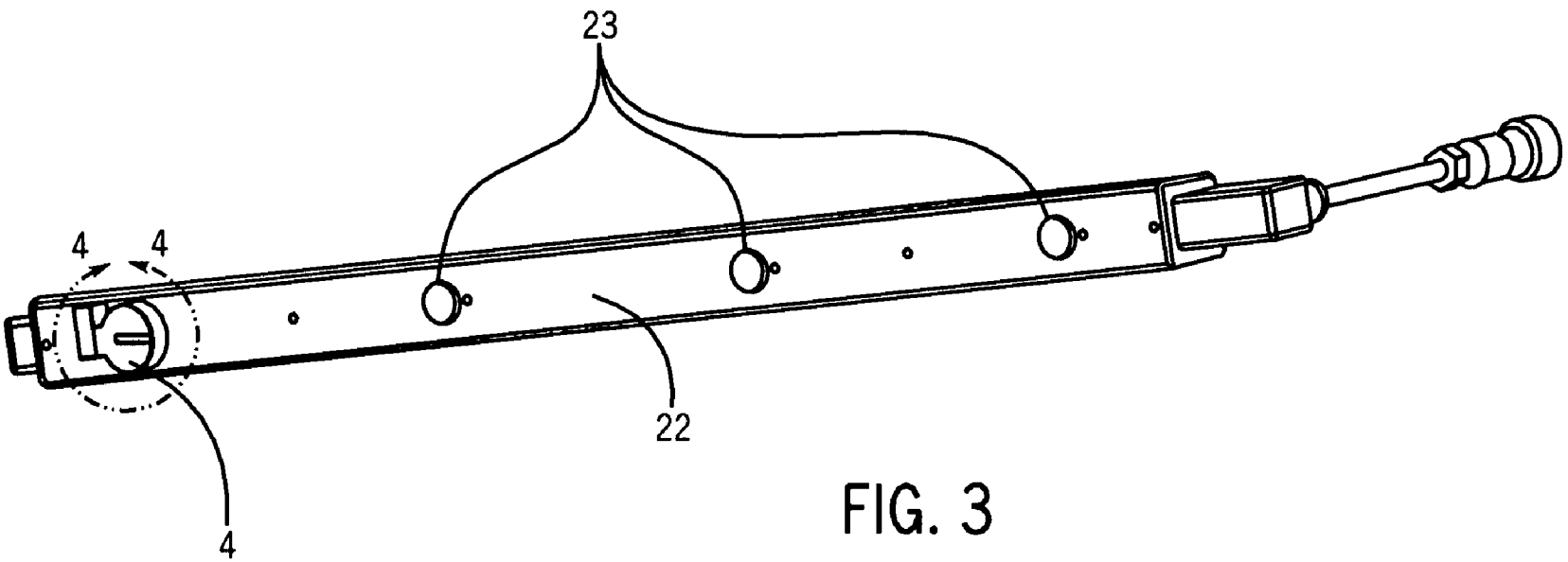
FIG. 3 a nozzle bar comprising a protective cap.

FIG. 3 shows an embodiment comprising an invention-based nozzle bar 22, which features different spray nozzles 23 with one of the spray nozzles being covered by the protective cap 4. FIG. 3 shows only one of the spray nozzles 23 having a protective cap 4 for the purpose of illustration. In one embodiment of such a nozzle bar 22 usually all spray nozzles 23 are equipped with a protective cap 4. On the right side of FIG. 3, a connection to a fluid line system 31 is shown but not depicted in detail.

Figure 4:
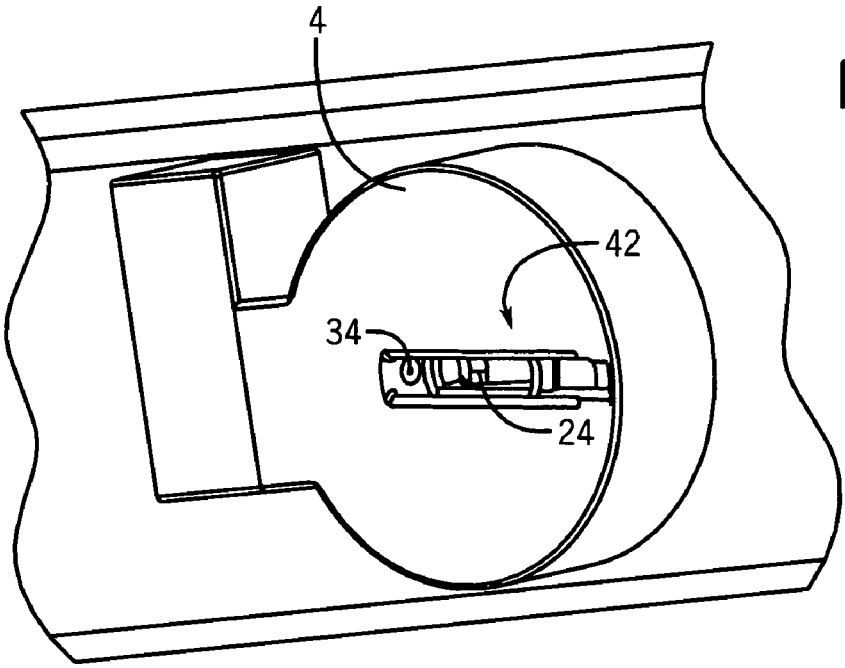
FIG. 4 an enlarged view of a spray nozzle of the nozzle bar equipped with a protective cap from FIG. 3, FIG. 5 a further embodiment of a protective cap, FIG. 6 a cross section view of a spray nozzle at a nozzle bar comprising a protective cap from FIG. 5, and FIG. 7 a cross section view of a further embodiment comprising a protective cap at a nozzle bar.

In FIG. 3, the area showing the protective cap 4 is surrounded by a dot-and-dashed line. In FIG. 4, this area is shown in enlarged view.

Accordingly, FIG. 4 shows the spray nozzle 23 of the nozzle bar 22 equipped with a protective cap. At the same time it shows an oblong spray jet aperture 42. The oblong form of the spray jet aperture 42 is adapted to the spray jet of a customary spray nozzle 23 in which the flat jet nozzles can be fan-shaped. The gap in the fluid jet aperture 42 in FIG. 4 shows inside the protective cap 4 a fluid nozzle 34 which can produce a fluid jet that can clean the spray nozzle outlet if required.

Figure 5:
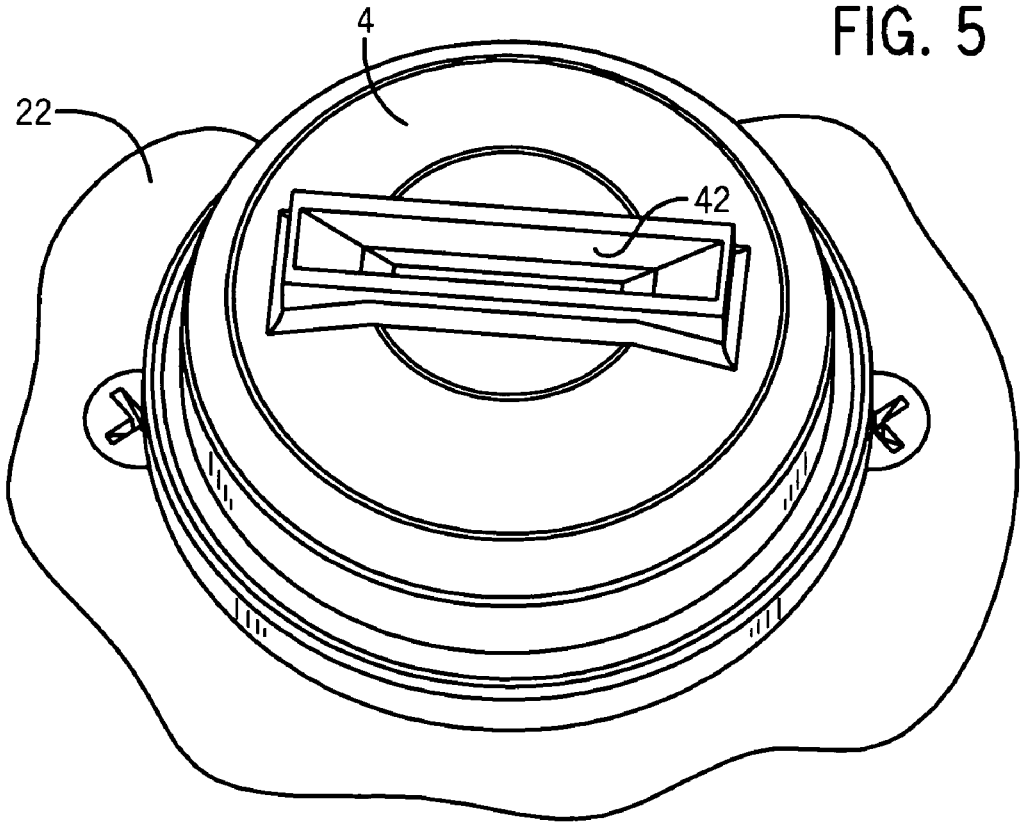
Figure 6:
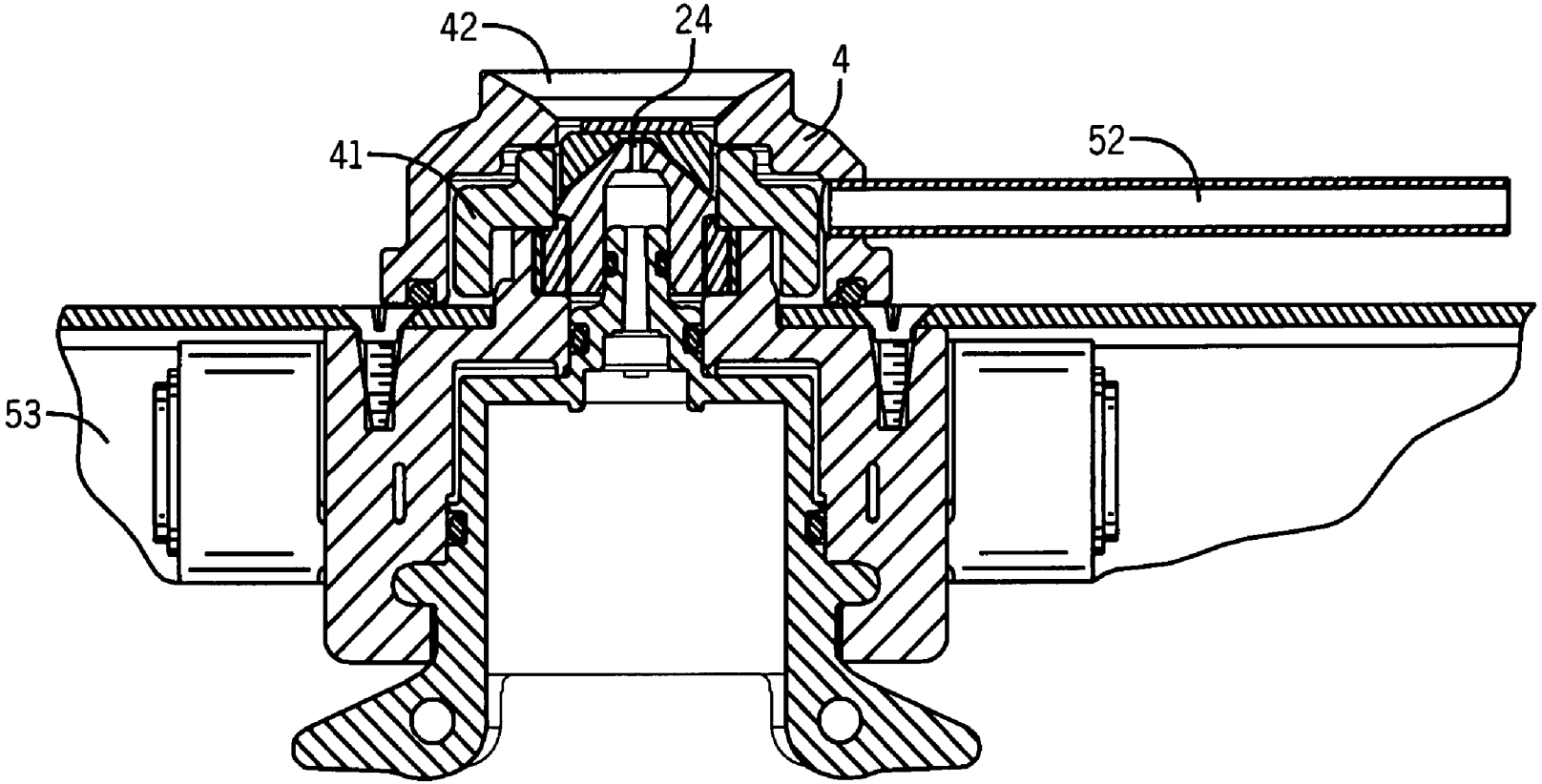
Figure 7:
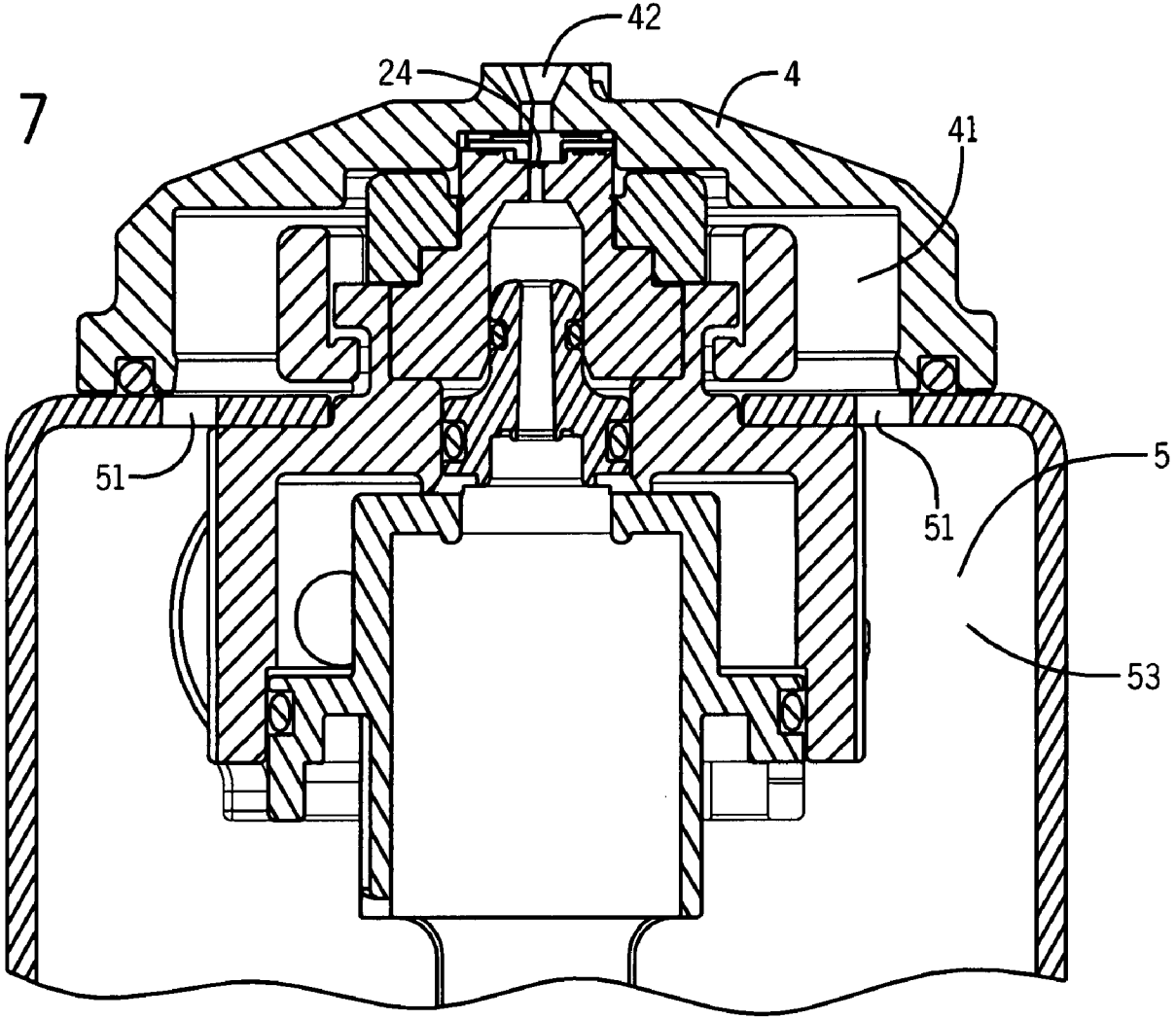

FIGS. 5 through 7 show further preferred embodiments of protective caps 4. The embodiments shown do not provide fluid nozzles. Even with these embodiments shown it is possible to provide fluid jet cleaning. The protective caps 4 shown are designed in such a way that they form jet pumps together with the spray nozzles 23. Said jet pumps discharge from a pure-air reservoir pure air by means of the spray jet aperture 42. In this way it is not possible that contaminated air from the spray chamber reaches in reverse order the interior space of the protective cap 41.

As already mentioned, it can be advantageous to provide further embodiments which provide a thus designed protective cap with the function of a jet pump which is also equipped with one or several fluid nozzles 34. Such combination guarantees the automatic removal of contaminations, which can deposit at the spray nozzles, for example, if the dampening unit is not in operation and there is also no function of the jet pump.

FIG. 5 shows an isometric view of an embodiment of a protective cap at a nozzle bar. It can be clearly seen that the spray jet aperture 42 comprises a diffuser area in which the aperture expands in spray direction toward the spray chamber.

FIG. 6 shows a cross section view of a spray nozzle from FIG. 5 which is arranged at a nozzle bar. This figure shows that the interior space 41 of the protective cap 4 is connected to a pure-air reservoir 52. Said pure-air reservoir 52 connects the interior space 41 of the protective cap 4 with a pure-air reservoir which is not shown in the figure.

It is also shown that the spray nozzle outlet 24 of the spray nozzle is located close to the spray nozzle aperture 42 which expands also in this embodiment in the direction of the spray chamber 21.

FIG. 7 shows a cross-section view of a further embodiment of the invention having a protective cap 4 at the nozzle bar.

This embodiment basically corresponds to the embodiment in FIG. 6. However, the cross section level shown is basically vertical to the cross-section level from FIG. 6. As a result, the spray jet aperture 42 in this embodiment is depicted smaller. This, in turn, clearly shows that the spray jet aperture 42 in spray jet direction initially features a narrower area with wall areas which, in the cross section shown, basically run parallel to the spray jet direction and which have merely a small distance to the spray jet produced. The distance of these wall areas to the spray jet can amount to between 0 mm and 3 mm. Particularly advantageous are distances larger than 0 mm and/or smaller than 0.7 mm.

Following the spray jet direction further it is shown that the spray jet aperture 42 expands like a funnel. This area is depicted as diffuser area.

It is also possible to provide a protective cap without such diffuser area.

The embodiment shown comprises a mixing area which is not designed as area of the spray jet aperture 42 but, instead, is located in the interior space 41 of the protective cap 4. This becomes evident in that the spray nozzle outlet 24 has a certain distance from the wall area in which the spray jet aperture 42 has been designed. It is also possible that the spray jet aperture comprises a mixing area featuring a larger cross section than the nozzle area.

Furthermore, FIG. 7 shows that at least one part of the pure-air reservoir 5 in this embodiment has been provided in the form of a housing interior 53 of the spray dampening unit or the nozzle bar. The interior space 41 of the protective cap 4 is connected with the pure-air reservoir 5 via a housing aperture 51 in a housing part of the nozzle bar. At the same time, it is possible that this embodiment also provides a pure-air line 52 which can connect the protective cap 4 shown, for example, with one or several adjoining protective cap(s) and/or a specially provided pure-air reservoir.

REFERENCE LIST

2 spray dampening unit
21 spray chamber
22 nozzle bar
23 spray nozzle
24 spray nozzle outlet
25 spray jet
3 spray nozzle cleaning device
31 fluid line system
33 fluid jet
34 fluid nozzle
4 protective cap
41 interior space
42 spray jet aperture
5 pure-air reservoir
51 housing aperture
52 pure-air line
53 housing interior

The invention claimed is:

1. An apparatus in a spray dampening unit of a printing press, comprising:

a nozzle bar including:

at least one spray nozzle on the nozzle bar in the spray dampening unit, and at least one protective cap surrounding the at least one spray nozzle, the protective cap having a spray jet aperture, which is structured such that a spray jet produced by the spray nozzle is sprayable through the spray jet aperture, the at least one protective cap overlaying and covering the at least one spray nozzle in the direction of a centerline of the spray jet produced by the at least one spray nozzle except for the spray jet aperture, and a spray nozzle cleaning device having a fluid line system operatively coupled between an unpressurized pure-air reservoir and the at least one spray nozzle, and arranged inside the protective cap, and with the spray nozzle cleaning device fixedly located relative to the nozzle bar, and the at least one spray nozzle and the respective spray jet aperture are structured such that they form a jet pump which discharges and propels air from the unpressurized pure-air reservoir supplied by the spray nozzle cleaning device to the inside of the protective cap, through the spray jet aperture with the spray jet.

2. A spray dampening unit, comprising:

at least one protective cap surrounding at least one spray nozzle, a spray jet aperture in each protective cap, each spray jet aperture structured such that a spray jet produced by the respective spray nozzle is sprayable through the respective spray jet aperture, the at least one protective cap overlying and covering the at least one spray nozzle in the direction of a centerline of the spray jet produced by the at least one spray nozzle except for the spray jet aperture, the protective cap including an interior space in flow connection with an unpressurized air reservoir, and the spray nozzle and the respective spray jet aperture are structured and arranged relative to each other such that a jet pump is formed which discharges and propels air from the unpressurized pure-air reservoir supplied to the interior space, through the spray jet aperture with the spray jet.

3. A method for preventing contamination of spray nozzles of a spray dampening unit, comprising the steps of:

separating at least one spray nozzle of a spray dampening unit from surrounding air with a protective cap that overlays and covers the at least one spray nozzle in the direction of a centerline of a spray jet produced by the at least one spray nozzle except for a spray jet aperture thereof;

supplying an interior space of the protective cap with uncompressed pure air from a pure-air reservoir that contains uncompressed pure air that is separated from surrounding air;

adapting aperture geometry of a spray jet aperture in the protective cap in relation to a spray jet geometry of a respective spray jet produced by each spray nozzle such that a jet pump is formed and, because of a flow speed of the spray jet, low pressure is produced in the spray jet aperture which results in an additional flow of pure air from the pure-air reservoir to an inside of the protective cap; and spraying the spray jet through the spray jet aperture in the protective cap such that the jet pump discharges and propels uncompressed pure air from the pure-air reservoir supplied to the interior space, through the spray jet aperture with the spray jet.

4. The method according to claim 3, wherein the spray dampening unit has a housing having a housing aperture, wherein a flow connection with the pure-air reservoir is effected by the housing aperture in the housing part of the spray dampening unit adjoining the interior space of the protective cap, and wherein the housing aperture connects the interior space of the protective cap with an interior space of the spray dampening unit housing.

5. The method according to claim 3, wherein the spray dampening unit has a housing interior, wherein the pure-air reservoir is located outside the housing interior, and wherein a flow connection between the interior space of the protective cap and the pure-air reservoir is effected by providing a pure-air line which establishes the flow connection between the interior space of the protective cap and the pure-air reservoir.

6. The method according to claim 5, wherein the pure-air line connects interior spaces of a plurality of protective caps with each other.

7. An apparatus for use with a spray nozzle of a spray dampening unit in a printing press, comprising:

a protective cap positioned around a spray nozzle, and having a spray jet aperture, which is structured such that a spray jet produced by the spray nozzle is sprayable through the spray jet aperture, the protective cap overlaying and covering the spray nozzle in the direction of the centerline of the spray jet produced by the spray nozzle except for the spray jet aperture, and protective cap having an interior space connected with a source of unpressurized air; and the spray jet aperture having an aperture geometry that is adapted in relation to a geometry of the spray jet such that a jet pump is formed by the protective cap at the spray nozzle through which a flow of the unpressurized air is producible in the spray jet aperture when the spray dampening unit is in operation, the unpressurized air flowing from an interior space of the protective cap into a spray chamber outside of the protective cap, such that the jet pump discharges and propels the unpressurized air from the interior space, through the spray jet aperture with the spray jet.

8. The apparatus according to claim 7, wherein the spray jet aperture comprises a nozzle area which has over a predetermined distance in a spray direction of the spray jet a substantially constant cross section of the opening which closely follows the spray jet.

9. The apparatus according to claim 8, wherein the spray jet aperture has in the spray direction a diffuser area adjoining the nozzle area at which, starting from a cross section of the aperture in the nozzle area, the cross section of the aperture in the diffuser area gradually opening like a funnel.

10. The apparatus according to claim 8, wherein the spray jet aperture has in the spray direction a confuser area assembled in front of the nozzle area at which the cross section of the aperture in the confuser area gradually narrows like a funnel until it reaches the cross section of the aperture in the nozzle area.

11. The apparatus according to claim 8, wherein the protective cap is structured such that, in assembled condition of the protective cap, a spray nozzle outlet of the spray nozzle is arranged at a predetermined distance in front of the spray jet aperture to provide a mixing area.

12. An apparatus, comprising:

a spray nozzle of a spray dampening unit in printing press;

a protective cap positioned around the spray nozzle, and having a spray jet aperture, which is structured such that a spray jet produced by the spray nozzle is sprayable through the spray jet aperture, the protective cap overlaying and covering the spray nozzle in the direction of a centerline of the spray jet produced by the spray nozzle except for the spray jet aperture, and the spray jet aperture having an aperture geometry that is adapted in relation to a geometry of the spray jet such that a jet pump is formed by the protective cap at the spray nozzle through which a flow of unpressurized air is producible in the spray jet aperture when the spray dampening unit is in operation, the unpressurized air flowing from an interior space of the protective cap into a spray chamber outside of the protective cap, such that the jet pump discharges and propels the unpressurized air from the interior space, through the spray jet aperture with the spray jet.

13. A spray dampening unit of a printing press, comprising:

a spray nozzle;

a protective cap positioned around the spray nozzle, and having a spray jet aperture, which is structured such that a spray jet produced by the spray nozzle is sprayable through the spray jet aperture, the protective cap overlaying and covering the spray nozzle in the direction of a centerline of the spray jet produced by the spray nozzle except for the spray jet aperture; and the spray jet aperture having an aperture geometry that is adapted in relation to a geometry of the spray jet such that a jet pump is formed by the protective cap at the spray nozzle through which a flow of unpressurized air is producible in the spray jet aperture when the spray dampening unit is in operation, the unpressurized air flowing from an interior space of the protective cap into a spray chamber outside of the protective cap, such that the jet pump discharges and propels the unpressurized air from the interior space, through the spray jet aperture with the spray jet.

14. The spray dampening unit according to claim 13, wherein the spray dampening unit further comprises a pure-air reservoir and a flow connection which connects an interior space of the protective cap with the pure-air reservoir.

15. The spray dampening unit according to claim 14, wherein the flow connection is a pure-air line, which connects the interior space of the protective cap with the pure-air reservoir.

16. The spray dampening unit according to claim 14, wherein the flow connection is a housing aperture, wherein the spray dampening unit has a housing having a housing aperture, wherein a flow connection with the pure-air reservoir is effected by the housing aperture in the housing part of the spray dampening unit adjoining the interior space of the protective cap, and wherein the housing aperture in the housing part of the spray dampening unit connects the interior space of the protective cap with an interior space of the spray dampening unit housing.

17. A spray dampening unit, comprising:

a spray nozzle;

a protective cap positioned around the spray nozzle, and having a spray jet aperture, which is structured such that a spray jet produced by the spray nozzle is sprayable through the spray jet aperture, the protective cap overlaying and covering the spray nozzle in the direction of a centerline of the spray jet produced by the spray nozzle except for the spray jet aperture; and the spray jet aperture having an aperture geometry that is adapted in relation to a geometry of the spray jet such that a jet pump is formed by the protective cap at the spray nozzle through which a flow of unpressurized air is producible in the spray jet aperture when the spray dampening unit is in operation, the unpressurized air flowing from an interior space of the protective cap into a spray chamber outside of the protective cap, such that the jet pump discharges and propels the unpressurized air from the interior space, through the spray jet aperture with the spray jet.

* * * * *